United States Patent [19]

Riblet

[11] 4,007,903

[45] Feb. 15, 1977

[54] APPARATUS FOR MAKING UNITARY CASING

[75] Inventor: Gordon Riblet, Wellesley, Mass.

[73] Assignee: Microwave Development Laboratories, Inc., Needham, Mass.

[22] Filed: Sept. 18, 1975

[21] Appl. No.: 614,449

[52] U.S. Cl. ..... 249/145; 249/184

[51] Int. Cl.[2] ..... B22C 9/24

[58] Field of Search ..... 249/145, 184–186

[56] References Cited

UNITED STATES PATENTS

| | | | |
|---|---|---|---|
| 1,516,667 | 11/1924 | Bungay | 249/184 X |
| 3,824,051 | 7/1974 | Leemput | 249/145 X |

*Primary Examiner*—Robert D. Baldwin

*Attorney, Agent, or Firm*—Wolf, Greenfield & Sacks

[57] ABSTRACT

A microwave circulator is die cast as a unitary casing by the apparatus of this invention. The circulator is characterized by two-fold symmetry regarding the external dimensions of the device and three-fold symmetry regarding the internal dimensions of the device in the central coupling area. The casing defining the circulator is poured in a single operation with the use of three independently employed cores which define the three ports of the circulator.

13 Claims, 19 Drawing Figures

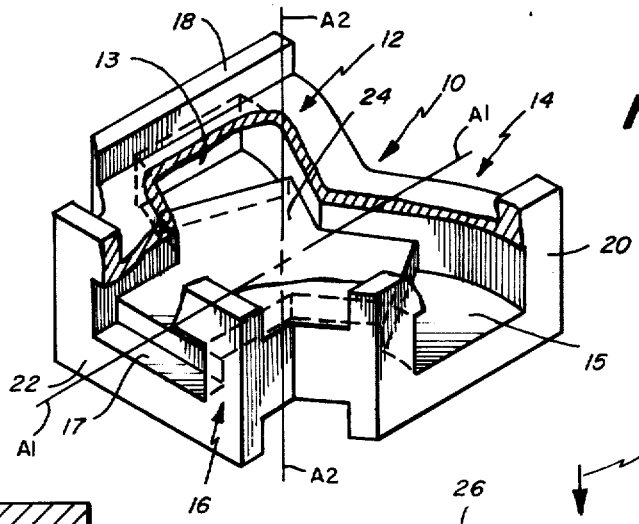
FIG. 1
FIG. 3
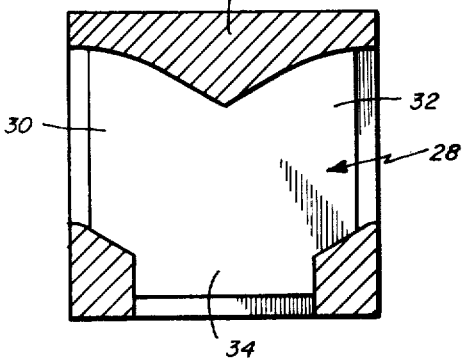
FIG. 2
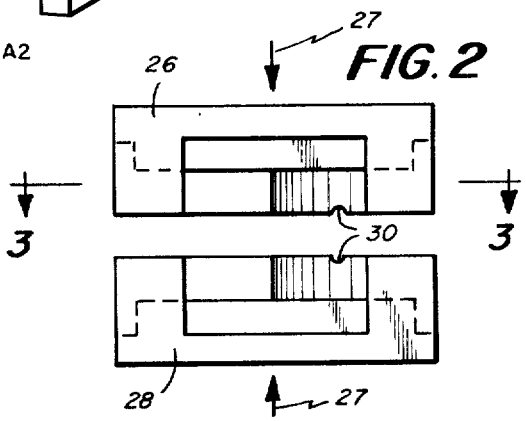
FIG. 4
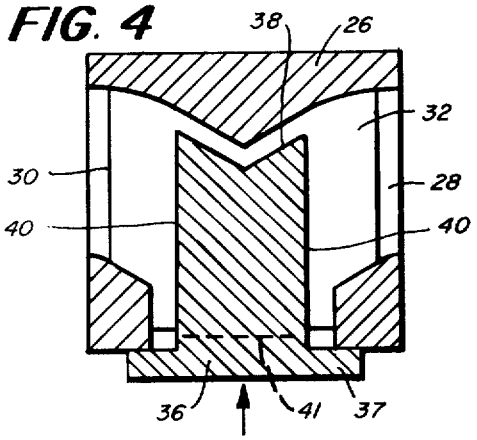
FIG. 5
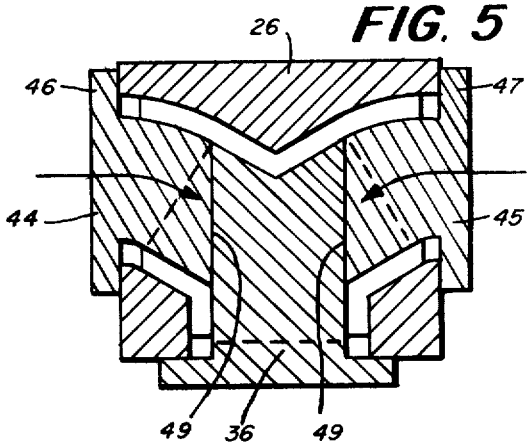
FIG. 6
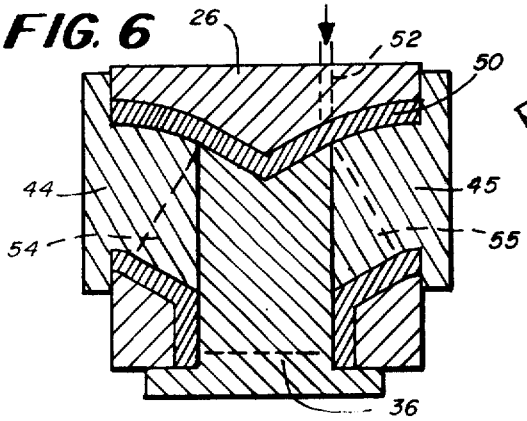
FIG. 7
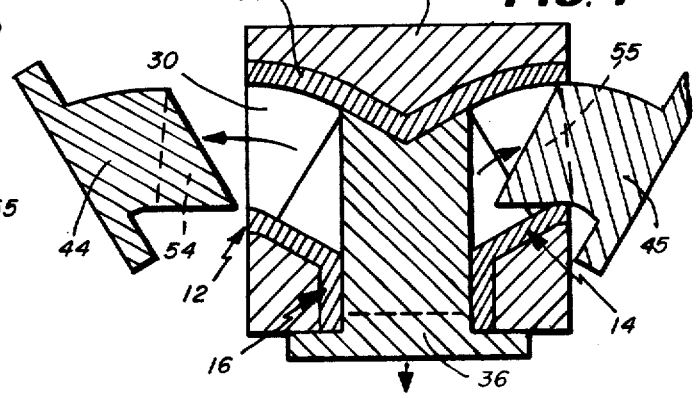

FIG. 16
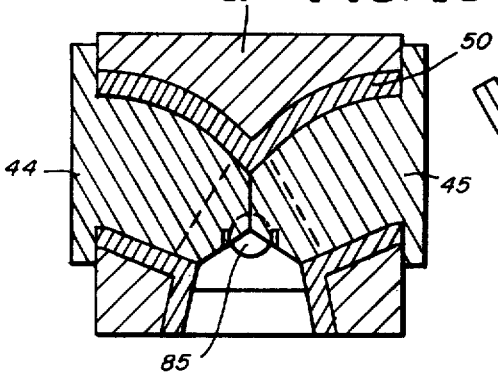
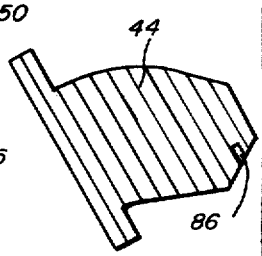
FIG. 17
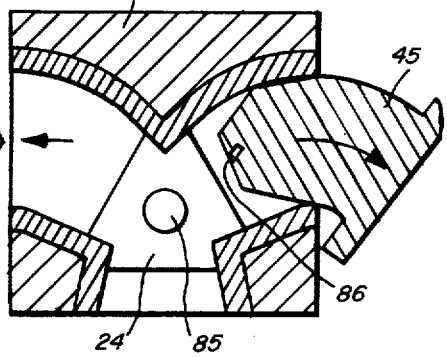
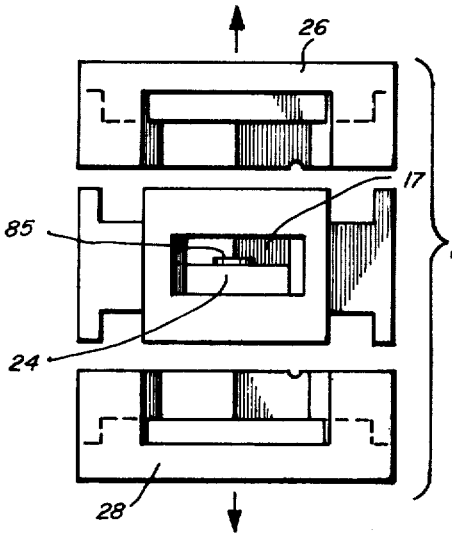
FIG. 18
FIG. 19
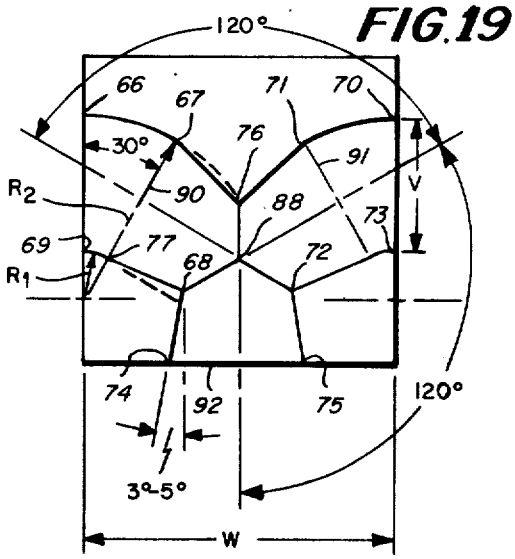

APPARATUS FOR MAKING UNITARY CASING

BACKGROUND OF THE INVENTION

The present invention pertains in general to apparatus of making a unitary casing. More particularly, this invention is concerned with apparatus for making a unitary casing which is in the form of a microwave circulator typically used in a microwave system.

At the present time a circulator is constructed in two pieces including a top piece and a bottom piece which are then suitably secured together using a suitable bolting arrangement to provide the usable circulator. Die casting of the circulator is often preferred as this is a more inexpensive way of construting the device than other casting methods such as investment casting. With this method of construction of the circulator it is rather time consuming to make the device and it is also necessary to make sure that the two halves that are assembled properly mate and align with each other.

Accordingly, an object of the present invention is to provide apparatus for making a unitary casing in the form of a microwave circulator. The circulator of this invention is constructed in a single operation by using a plurality of cores.

Another object of the present invention is to provide a circulator that is constructed in one piece and that has two-fold symmetry concerning its outer dimensions and three-fold symmetry at least in the central area of the circulator.

A further object of the present invention is to provide a apparatus for making a unitary casing using a plurality of separate cores having ends that abut each other when in position.

Still a further object of the present invention is to provide apparatus for making a unitary casing preferably defining a microwave circulator and that uses a plurality of cores having interlocking means associated therewith for securing the cores in place.

SUMMARY OF THE INVENTION

To accomplish the foregoing and other objects of this invention, there is provided an apparatus for die casting a member which, in the preferred embodiment, is a microwave circulator. This apparatus comprises two pieces which interengage to define a mold having a plurality of apertures therein to receive a like plurality of core pieces. Each of the core pieces interengage or abut each other when inserted in the mold and together define a core. Each of the core pieces, in one embodiment, has at least a section that is symmetrical with the other core pieces to provide symmetry in the casing or circulator that is to be constructed. In an alternate embodiment one of the core pieces may be somewhat elongated with the other two core pieces being identical in shape but somewhat shorter in length than the first core piece. The core pieces are constructed to provide arcuate inner walls in the casings which are slightly tapered or include a flat tapered section to permit easy withdrawal of the core pieces after the casing has been fabricated.

In accordance with this invention, the two pieces that define the mold are interengaged and the plurality of core pieces are inserted in different directions into the mold with end surfaces of the core pieces engaging or abutting to form the core for the mold. The molten material is then poured into the mold in a well known manner and about the core. After the material has hardened, the core pieces are withdrawn from the mold and the two pieces defining the mold are separated.

BRIEF DESCRIPTION OF THE DRAWINGS

Numerous other objects features and advantages of the invention should now become apparent upon a reading of the following detailed description taken in conjunction with the accompanying drawings, in which:

FIG. 1 is a perspective view of a microwave circulator constructed in accordance with the principles of the present invention;

FIG. 2 shows the two piece mold used in constructing the casing shown in FIG. 1;

FIG. 3 is a cross sectional view taken along line 3—3 of FIG. 2 prior to insertion of the core pieces;

FIG. 4 is a cross sectional view similar to that shown in FIG. 3 with one of the core pieces inserted;

FIG. 5 is a view similar to that shown in FIG. 4 with the other two core pieces also inserted into the mold;

FIG. 6 indicates the pouring of the material into the mold;

FIG. 7 is still a further cross sectional view with two of the core pieces being withdrawn;

FIG. 16 is a view similar to that shown in FIG. 15 with one of the core pieces withdrawn;

FIG. 17 shows the other two core pieces being withdrawn from the mold;

FIG. 18 is an exploded view of the two piece mold and finished casing or circulator; and FIG. 19 is a schematic diagram showing the exact construction of this second embodiment similar to the diagram shown in FIG. 10 with reference to the first embodiment.

DETAILED DESCRIPTION

Figure 8:
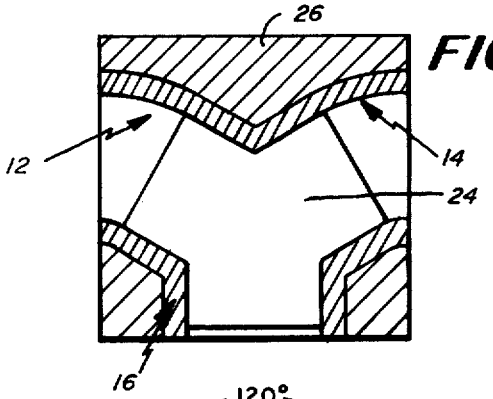
FIG. 8 is the same cross sectional view shown in FIG. 3 but with all of the core pieces withdrawn.

The principle of the present invention is disclosed herein for constructing a microwave circulator. However, the principles of this invention may also be used for constructing other devices. With the principle of this invention a one-piece, unitary casing is constructed, which casing is provided with a plurality of ports or through passages. It is important in constructing a microwave circulator that there be three-fold symmetry at least in the central area of the circulator where the three ports communicate with each other.

FIG. 1 shows such a circulator 10 constructed in accordance with the principles of the present invention. The perspective views shown in FIG. 1 is partially cut-a-way to expose internal portions of the device. The circulator comprises legs 12, 14 and 16 each respectively defining energy coupling ports 13, 15 and 17. These legs 12, 14 and 16 also terminate in respective flanged ends 18, 20 and 22. These flanged ends may connect in a suitable manner to other microwave apparatus. For example, the leg 12 may couple to a microwave generator, the leg 14 may couple to an antenna and the leg 16 may couple to a terminating load. The circulator may also have an internal step 24 to provide proper matching and which may have a ferrite disc supported thereon. The step 24 provides improved broad band performance. With this arrangement a magnet is disposed in a wall opposite to this ferrite disc.

FIGS. 2–10 show how the circulator of FIG. 1 is constructed and some of the important dimensions associated therewith. FIG. 2 shows the two pieces 26 and 28 which define the mold for fabricating the circulator shown in FIG. 1. The arrows 26, shown in FIG. 2 indicate the direction that the two pieces are brought together. The two pieces may be aligned in a well known manner such as by use of the aligning slots 30. The two pieces 26 and 28 are, of course, configured so as to provide the flanges 18, 20 and 22. The two pieces 26 and 28 also define three mold passages 30, 32 and 34, as shown in FIG. 3, which in part define the legs 12, 14 and 16, respectively, of the circulator 10 shown in FIG. 1. The two mold pieces 26 and 28 are shown secured together in FIG. 3 and may be secured together in any well known manner such as by the use of suitable clamps.

FIGS. 4 and 5 show two subsequent steps in the method according to the present invention. In FIG. 4 an elongated core piece 36 is shown in place in the passage 34 and extending partially at its ends into the other two passages 30 and 32. The core piece 36 has an outer cap 37 which limits its movement into the mold. The piece 36 is somewhat elongated having a V-shaped end 38 and a rectangular cross section. The core piece 36 is defined by preferably four slanted wall surfaces 40 and has a lower section cut out along line 41 to accommodate the step 24 shown in FIG. 1.

FIG. 5 shows the other two core pieces 44 and 45 each of which has a flanged end 46 and 47, respectively. The main body of each of the core pieces 44 and 45 extend, respectively, through the passages 30 and 32 and have their flat ends 49 abutting against the slanted surfaces 40 of the more elongated core piece 36. All of the core pieces shown in FIG. 5 may be aligned with the use of interlocking nipples or the like and each of the core pieces may be aligned with the two-piece mold by suitable aligning pins, for example. The aligning pins may extend from the flanges 46 and 47, for example, and can be secured into apertures in the mold pieces 26 and 28 so that the core pieces are properly arranged in the passages and properly centered therein.

FIG. 6 shows the core pieces 36, 44 and 45 in place and the molten metal material 50 in the mold cavity defined between the core and mold pieces. This material 50 may be introduced into the mold cavity by way of passage 52 and may be introduced under pressure. It is noted in FIGS. 5–7 that the core pieces 44 and 45 also have cut-out triangular sections 54 and 55 which along with the cut-out section along line 41 of the core piece 36 at least partially define the step 24. Of course, this device could also be fabricated without providing a step in which event the cut-out sections are not necessary.

Figure 9:
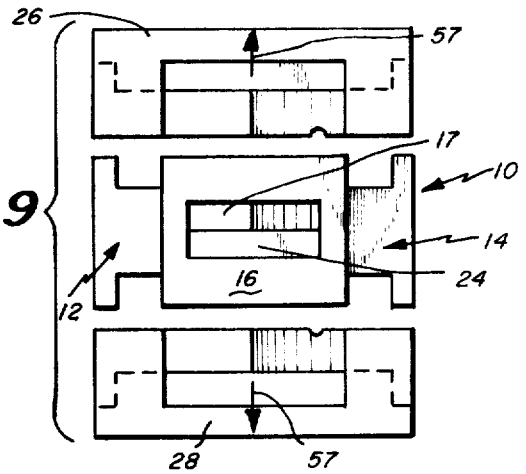
FIG. 9 is an exploded view showing the two-piece mold and the finished casing.

FIG. 7 shows two of the core pieces 44 and 45 having been withdrawn from the mold after the molten material 50 has hardened into a casing. Further, in FIG. 8, all three of the core pieces have been removed and there is shown the step 24. Furthermore, the exploded view of FIG. 9 shows the two mold pieces 26 and 28 removed in the direction of the arrows 57 so that the circulator 14 is completely removed from the mold. FIG. 9 shows the constructed circulator with its leg 12, 14 and 16.

As previously mentioned, it is desirable to have three-fold symmetry especially in the center area of the circulator. It is desirable to maintain this symmetry for a distance of about a quarter wave length in the waveguide medium measured from the edge of the ferrite disc (not shown in the first embodiment). In this connection reference is now made to FIG. 10 which schematically shows the porting arrangement of the circulator in one plane. In the other plane the core pieces can be slightly tapered as all of the surfaces in the other plane are flat surfaces. However, in the plane shown in FIG. 10 a more complex geometric construction is used.

Figure 10:
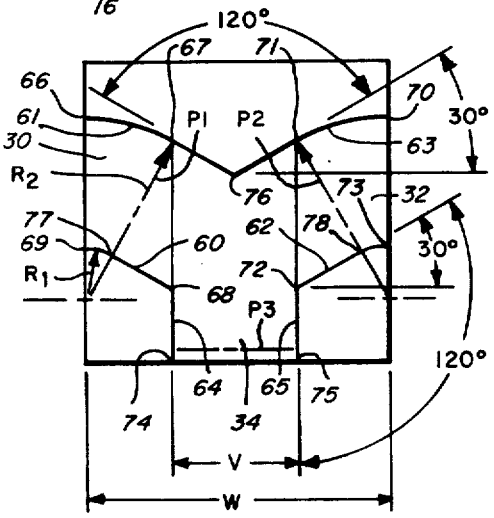
FIG. 10 is a schematic diagram showing the precise construction of the ports defined by the core pieces in the casing.
Figure 11:
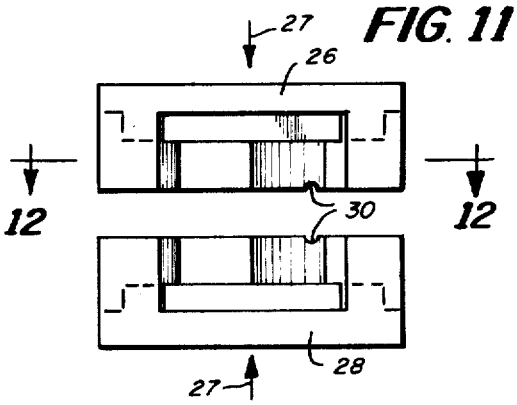
FIG. 11 shows a two-piece mold that is separated for a different embodiment of the invention.
Figure 12:
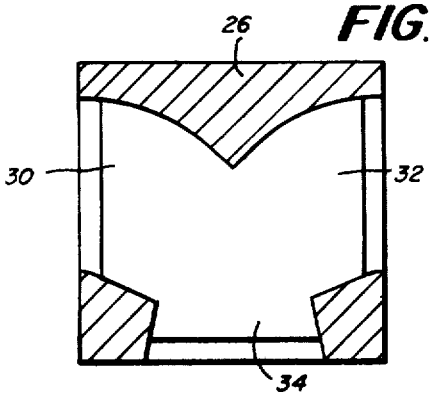
FIG. 12 is a cross sectional view taken along line 12—12 of FIG. 11.
Figure 13:
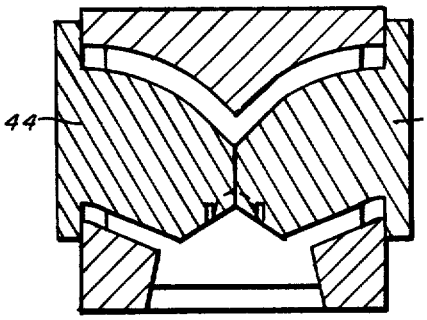
FIG. 13 is a similar cross-sectional view with two of the core pieces in place.
Figure 14:
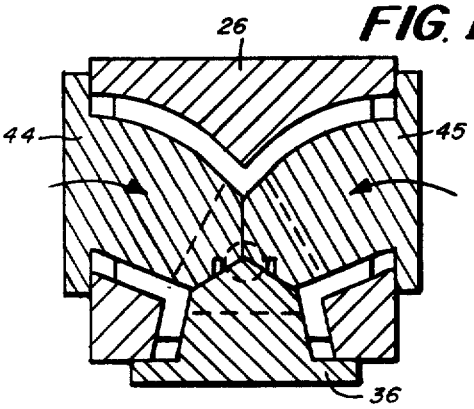
FIG. 14 shows all three of the core pieces in place.
Figure 15:
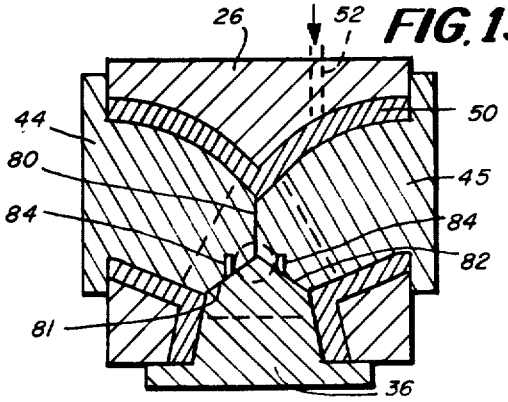
FIG. 15 is a view like that shown in FIG. 14 with the material being poured into the mold.

In FIG. 10 the passage 30 is defined by wall surfaces 60 and 61; the passage 32 is defined by wall surfaces 62 and 63; and the passage 34 is defined by wall surfaces 64 and 65. Although the core pieces are not shown in FIG. 10, it may be assumed that they have the shape of the wall surfaces. Thus, the core piece 44 is defined between the points 66, 67, 68 and 69 and the core piece 45 is similarly defined between points 70, 71, 72 and 73. The core piece 36 is defined between points 74, 67, 71 and 75. The wall surfaces 60, 61, 62 and 63 each include a straight portion and an arcuate portion. The straight portions of wall surfaces 61 and 63 are defined between points 76 and 67 and points 76 and 71, respectively. Similarly, the straight or flat sections of the wall surfaces 60 and 62 are defined between points 77 and 68 and points 72 and 78, respectively. All of the straight sections of the wall surfaces which join each other are disposed at an angle of 120° in the disclosed embodiment. However, these walls may also have a slight taper to facilitate removal of the core pieces. It is seen in FIG. 10 that the extension of wall surface 65 terminates at point 71 and the extension of wall surface 64 terminates at points 67.

In designing the core pieces for this first embodiment certain parameters are known such as the circulator width W and the port width V. Because the straight wall portions are disposed at 120° to each other the points 67, 76, 71; 78, 72, 75; and 77, 68, 74 are known to fall along these straight wall portions. The reference planes P1, P2 and P3 shown in FIG. 10 can be somewhat arbitrarily selected and are selected in the embodiment of FIG. 10 to provide a maximum area of three-fold symmetry. Each of the reference planes are, of course, perpendicular to the straight wall portions. It is noted, for example, that the reference plane P2 terminates at point 71 and point 71 coincides with the extension of wall 65. The points 67 and 77 define a line (reference plane P1) intersecting at the center of radii R1 and R2. This intersection takes place at the edge of the circulator. Similarly, points 71 and 78 define a line from which the center of the radii can be drawn. The radii R1 and R2 subtend arcs connecting points 66 and 67; 69 and 77 on one side and points 71 and 70; and 78 and 73 on the other side.

With the configuration shown in FIG. 10 it is apparent that the core pieces, and in particular the core pieces 44 and 45, can be withdrawn such as shown in FIG. 7 after the device has been formed. Also, the core pieces are constructed so that there is an intimate mating at the engaging surfaces between the three core pieces.

The reference planes P1, P2 and P3 can also be moved inwardly toward each other to effectively shorten the straight wall portions. As long as all of the planes are moved in an equal distance, the three-fold symmetry is maintained. With this arrangement the radii are somewhat larger and the poll piece 36 may have a tapered end between points 67 and 68, and points 71 and 72.

As previously mentioned the device of FIG. 10 has three-fold symmetry in the area defined by points 67, 76, 71, 78, 72, 75, 74, 68 and 77, thereby yielding desirable electrical characteristics. Concerning the outside dimensions of the circulator shown in FIG. 10, there is two-fold symmetry about the axis A1 (see FIG. 1). This two-fold symmetry permits an in-line arrangement for connection to a generator and antenna, for example. The three-fold symmetry is about an axis A2 of revolution as shown in FIG. 1.

In FIGS. 11–19, the like reference characters will be used for identification of like parts previously designated in FIGS. 1–10. In this second embodiment of the invention, the passages of the circulator are substantially of the same configuration as in the first embodiment but the core pieces are constructed in a different manner. The second embodiment is particularly useful, if it is desired to provide a support post on top of the step 24 for supporting a ferrite disc.

As shown in the series of drawings of the second embodiment, the sequence of operation is substantially the same as with reference to the first embodiment. However, the structure of the core pieces 36, 44 and 45 is different in the second embodiment. The specific construction is discussed hereinafter with reference to the detailed diagram of FIG. 19. However, it is noted that the core pieces are themselves of more symmetrical design and are mutually joined along axis lines 80, 81 and 82 (see FIG. 15). With this configuration it is possible for instance to provide arcuate cut-outs in the ends of each of the core pieces for the purpose of fabricating the cylindrical shaped support post 85 shown in FIGS. 16–18. The second embodiment also shows an interlocking arrangement for securing the core pieces together. This arrangement includes pins 84 which mate with apertures 86. The pins extend from the core piece 36 and the apertures are provided in the two other core pieces 44 and 45.

FIG. 19 shows more precisely the construction of each of the core pieces. Actually, the core pieces are not shown in FIG. 19 but do conform to the walls depicted in FIG. 19. Thus, the core piece 36 extends between the points 68, 72, 75 and 74. The core piece 44 extends between the points 69, 68, 88, 76, 67 and 66. The core piece 45 extends between the points 70, 71, 76, 88, 72 and 73. The pointed ends of each of the core pieces are of the same shape and define a 120° angle at their apex. The straight wall surfaces of each of the core pieces, such as is defined between points 67 and 76, is tapered slightly with the amount of taper being a function of the width of the circulator and the desired location of the reference planes 90, 91 and 92.

In designing the core pieces of this second embodiment again certain parameters are known such as the circulator width, port width and location of the reference planes from the center point 88. The lines defined by center point 88 and respective points 76, 68 and 72 extend at 120° to each other but initially the points 76, 68 and 72 are not known. Reference plane 90, for example, can be drawn at the desired distance from point 88 and is at an angle of 30° from the end wall of the circulator. Given the port width and circulator width the center point for the radii R1 and R2 is located. Thus the arcuate segments 66, 67 and 69, 77 can be defined and the arc can be continued as shown in dotted in FIG. 19. Point 76 is then chosen to coincide with the arc or fall inside the arc. Likewise, point 68 is selected to fall on the arc or outside of the arc. Of course the length 76, 88 is made the same as the length 68, 88. By defining the points 76, 68 and 72 in this manner the straight walls of the core pieces have sufficient taper to allow easy removal of each core piece.

Having described a limited number of embodiments of the present invention, it should now become apparent to one skilled in the art that numerous modifications can be made in the disclosed embodiments without departing from the scope of this invention. For example, the cores can be fabricated of different types of material but preferably are constructed of a metal material such as steel. The mold can be filled in many different manners and the core can be supported in any suitable manner such as by the use of aligning pegs or in other manners which are well known for supporting a core in a mold cavity.

What is claimed is:

1. Apparatus for constructng a microwave circulator having three ports comprising:

two pieces which interengage to define a mold and have means for introducing a molten material into the mold, said two pieces defining three passages meeting inside the mold at a common passage interconnecting area, three core pieces which interengage or abut when inserted respectively in the three passages in the mold to define a mold core, means for maintaining each core piece symmetrically in its associated passage of the mold, a space being provided between the core and pieces for being filled about the core with the molten material to thereby define walls of the circulator, one of said core pieces being longer than the other two core pieces including substantially straight parallel side surfaces and having a rectangular cross-section, the other two of said core pieces having end surfaces that abut the substantially straight parallel surfaces of the one core piece and side surfaces that include at least an outer arcuate surface segment extending longitudinally of the core pieces.

2. Apparatus as set forth in claim 1 wherein each of said core pieces has means defining a step providing a thinner end for each core piece to thereby define a transformer step for the circulator.

3. Apparatus as set forth in claim 1 wherein the means for maintaining comprises a flange of each core piece at an outer end of each core piece.

4. Apparatus as set forth in claim 1 wherein said one core piece has a V-shaped end surface.

5. Apparatus as set forth in claim 4 wherein the straight surface segments of each piece are in parallel arrangement.

6. Apparatus as set forth in claim 1 wherein the other two core pieces have side surfaces that include both arcuate and linear surface segments.

7. Apparatus for constructing a microwave circulator having three ports comprising:

two pieces which interengage to define a mold and have means for introducing a molten material into the mold, said two pieces defining three passages meeting inside the mold at a common passage interconnecting area, three core pieces which interengage or abut when inserted respectively in the three passages in the mold to define a mold core, means for maintaining each core piece symmetrically in its associated passage of the mold, a space being provided between the core and pieces for being filled about the core with the molten material to thereby define walls of the circulator, one of said core pieces having tapered side surfaces and a rectangular cross-section, the other two of said core pieces having end surfaces that abut each other and also abut the one core piece, and having side surfaces that include at least an outer arcuate surface segment extending longitudinally of the core pieces.

8. Apparatus as set forth in claim 7 wherein each of said core pieces has means defining a step providing a thinner end for each core piece to thereby define a transformer step for the circulator.

9. Apparatus as set forth in claim 7 wherein the means for maintaining comprises a flange of each core piece at an outer end of each core piece.

10. Apparatus as set forth in claim 7 wherein each core piece has a two surfaced end meeting at an angle of 120° F.

11. Apparatus as set forth in claim 7 wherein the other two core pieces have side surfaces that include both arcuate and linear surface segments.

12. Apparatus as set forth in claim 11 wherein the linear surface segments of each piece are tapered converging toward the inside of the mold.

13. Apparatus for constructing a microwave circulator having three ports comprising:

two pieces which interengage to define a mold and have means for introducing a molten material into the mold, said two pieces defining three passages meeting inside the mold at a common passage interconnecting area, three core pieces which interengage or abut when inserted respectively in the three passages in the mold to define a mold core, means for maintaining each core piece symmetrically in its associated passage of the mold, a space being provided between the core and pieces for being filled about the core with the molten material to thereby define walls of the circulator, one of said core pieces having a rectangular cross-section, the other two of said core pieces also having a rectangular cross-section, having end surfaces that abut the end of the one core piece and having side surfaces that include both arcuate and linear surface segments extending longitudinally of the core pieces.

* * * * *